US007165522B2

(12) United States Patent
Malek et al.

(10) Patent No.: US 7,165,522 B2
(45) Date of Patent: Jan. 23, 2007

(54) CYLINDER HEAD OF AN INTERNAL COMBUSTION ENGINE HAVING A CAMSHAFT BEARING RAIL

(75) Inventors: Georg Malek, Munich (DE); Doris Schiecke, Tutzing (DE); Axel Temmesfeld, Gstadt (DE); Brian O'Reilly, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 11/116,174

(22) Filed: Apr. 28, 2005

(65) Prior Publication Data

US 2005/0252470 A1 Nov. 17, 2005

Related U.S. Application Data

(63) Continuation of application No. PCT/EP03/10303, filed on Sep. 16, 2003.

(51) Int. Cl.
*F01M 1/06* (2006.01)

(52) U.S. Cl. ..... 123/90.34; 123/90.33; 123/90.27

(58) Field of Classification Search ..... 123/90.34, 123/90.27, 90.33, 193.5
See application file for complete search history.

(56) References Cited

U.S. PATENT DOCUMENTS

| | | | | |
|---|---|---|---|---|
| 4,637,356 | A | 1/1987 | Kuroda | |
| 5,704,330 | A | 1/1998 | Tsuchida | |
| 5,875,754 | A | 3/1999 | Ickinger | |
| 6,279,529 | B1 | 8/2001 | Komatsu et al. | |
| 6,418,903 | B1 * | 7/2002 | Muller et al. | 123/195 R |
| 6,516,764 | B1 * | 2/2003 | Uchida | 123/90.27 |
| 2001/0037787 | A1 | 11/2001 | Muller et al. | |

FOREIGN PATENT DOCUMENTS

| | | |
|---|---|---|
| DE | 39 40 845 C 1 | 12/1989 |
| DE | 41 17 006 C 2 | 5/1991 |
| DE | 691 00 277 T 2 | 6/1991 |
| DE | 43 23 073 A 1 | 7/1993 |
| DE | 43 24 791 A 1 | 7/1993 |
| DE | 694 14 557 T 2 | 7/1994 |
| DE | 695 04 709 T 2 | 12/1995 |
| DE | 100 34 329 C 2 | 7/2000 |
| DE | 201 20 912 U 1 | 12/2001 |
| EP | 0 967 381 B1 | 4/1999 |
| GB | 865 351 | 4/1961 |
| JP | 2000306292 A * | 11/2000 |

OTHER PUBLICATIONS

Abstract, JP 2000306292 A, Nov. 2000, Washimi, Hitoshi.*

* cited by examiner

*Primary Examiner*—Thomas Denion
*Assistant Examiner*—Zelalem Eshete
(74) *Attorney, Agent, or Firm*—Crowell & Moring LLP

(57) ABSTRACT

A cylinder head of an internal combustion engine is provided with a cylinder head housing and with a divided camshaft bearing rail having a lower part, which comprises lower bearing blocks, and having an upper part, which comprises upper bearing covers. In addition, the cylinder head has a cylinder head cover. The upper part of the camshaft bearing rail is designed so that it is closed like a hood, in particular, in the area between the bearing covers.

8 Claims, 4 Drawing Sheets

CYLINDER HEAD OF AN INTERNAL COMBUSTION ENGINE HAVING A CAMSHAFT BEARING RAIL

This application is a continuation of International Patent Application No. PCT/EP2003/010303, filed Sep. 16, 2003, the entire disclosure of which is incorporated herein by reference. Priority is claimed based on German Patent Application No. 102 50 303.6, filed Oct. 29, 2002.

BACKGROUND AND SUMMARY OF THE INVENTION

The present invention relates to a cylinder head of an internal combustion engine having a cylinder head housing, a camshaft bearing strip in two parts with a lower part comprising lower bearing blocks and an upper part comprising upper bearing covers plus a rocker cover.

German Patent DE 39 40 845 C1 discloses a cylinder head of an internal combustion engine with a frame-like beam divided into two parts horizontally for camshaft bearing. The lower part of the beam described here has crossbars, each comprising lower parts of the bearing for supporting the intake and exhaust camshaft in which additional struts and supports and receptacles for bucket tappets are arranged between the spaces formed by the crossbars. The upper part of the beam also has crossbars, comprising bearing upper parts corresponding to the bearing lower parts of the lower part for supporting the intake and exhaust camshaft. The upper part of the carrier is also designed to be open toward the upper in the manner of a frame.

With the camshaft carrier according to German Patent DE 39 40 845 C1, the spaces formed between the crossbars are accessible only from above through the upper part of the carrier, e.g., for the introduction of supporting bearings in machining the bearing channels due to the arrangement for accommodating the bucket tappets and the central webs. The upper part of the carrier is necessarily designed to be open at the top so that the arrangement does not provide any protection from splashing oil thrown by the cams during operation of the internal combustion engine and the oil is thrown directly onto the rocker cover, in which case the gaskets between the rocker cover and the cylinder head housing as well as gaskets in the area of the spark plug dome are put under particular stress. In addition, the carrier has only a low resistance torque due to its frame-like design so that there is not adequate rigidity, especially in the longitudinal direction.

The object of the present invention is to improve upon a cylinder head such that an especially great rigidity is achieved in a simple and inexpensive manner, and advantageous production of the camshaft carrier in particular from the standpoint of manufacturing technology is made possible. In addition, the cylinder head should be lightweight and should include only a few parts.

This object is achieved with the features of the present invention, whereby the underlying idea includes a design of the upper part of the camshaft bearing strip which is closed in the manner of a hood, in particular in the area between the bearing covers.

It is especially advantageous here if the camshaft bearing strip comprises integrated oil channels for supplying oil to the camshaft bearing and/or the cams. For example, the oil may be supplied to the oil channels from beneath through the lower part of the camshaft bearing strip in which case channels in the longitudinal direction of the bearing strip convey the lubricant oil to the bearing sites and/or to the cams.

It is regarded as very expedient to manufacture the camshaft bearing strip of a pressure casting of a magnesium alloy and to machine it so that it is at least approximately finished before installation independently of the other components of the cylinder head.

Supporting bearings can be introduced through the lower part from beneath advantageously for machining the bearing channels of the camshaft bearing strip.

According to an especially preferred embodiment of this invention, aluminum screws are provided for fastening the camshaft bearing strip on the cylinder head housing, in particular in an embodiment in which the camshaft bearing strip is made of a magnesium alloy and the cylinder head housing is made of steel and/or aluminum, in which case a particular advantage lies in the low prestress losses of this connection.

It is especially expedient if the joint faces between the camshaft bearing strip and the cylinder head housing and also between the rocker cover and the cylinder head housing are situated in a plane so that finished machining of the cylinder head housing can be performed in one plane.

Preferably a separate camshaft bearing strip is provided for supporting an intake or exhaust camshaft, which thus yields especially structural freedom.

In addition, it is regarded as very advantageous if the spark plug domes for accommodation of the spark plugs are integrally cast in the rocker cover. In comparison with an embodiment with separate pipe connections introduced into the rocker cover for accommodating the spark plugs, this eliminates an additional connection and seal; in comparison with spark plug domes which are cast with the cylinder head housing, this yields the advantage that an embodiment together with the rocker cover in a magnesium alloy is possible.

Other objects, advantages and novel features of the present invention will become apparent from the following detailed description of the invention when considered in conjunction with the accompanying drawings.

DETAILED DESCRIPTION

Figure 1:
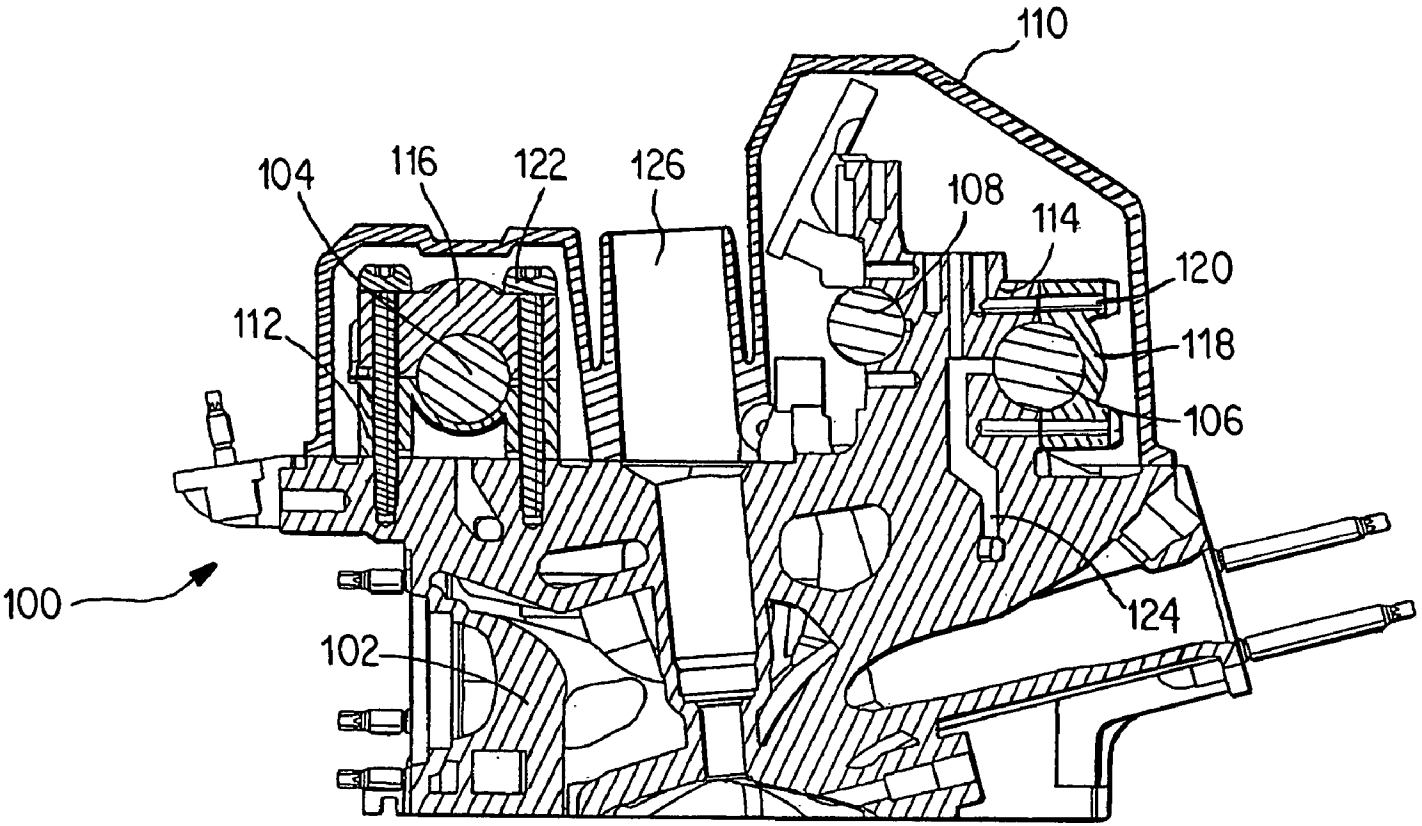
FIG. 1 shows a section through a cylinder head in accordance with an embodiment of the present invention.

FIG. 1 shows an embodiment of a cylinder head 100 on the example of an internal combustion engine with variable valve drive in which a quantitative dosing of the cylinder charge is accomplished via a variable lift of the intake valves. The cylinder head 100 has a cylinder head housing 102, a camshaft 106 for operation of intake valves (not shown here) with lower camshaft bearing blocks 112 and upper camshaft bearing covers 116 attached by screws 122 to the cylinder head housing 102, a camshaft 104 for operation of exhaust valves (not shown here) with lower camshaft bearing blocks 114 and upper camshaft bearing covers 118 which are attached by screws 120 to the cylinder head housing 102 and a rocker cover 110. In the area of the intake camshaft 106 an eccentric shaft 108 is arranged and supported for controlling the change in lift of the intake valves. The rocker cover 110 comprises integrated domes 126 for accommodating spark plugs. Oil channels 124 are provided for supplying oil to the cams and camshaft bearings.

In the present exemplary embodiment, the cylinder head housing 102 is made of cast steel and/or aluminum. In particular, the arrangements comprising the bearing blocks 112, 114 and bearing covers 116, 118 as well as the rocker cover 110 are made of a magnesium alloy so that special weight savings are achieved with a high rigidity at the same time. Machining of components of different materials is performed separately so that there is no increase in machining complexity due to the mix of materials. In addition—since the arrangements for supporting the camshaft can be installed in a completely machined state—it is not necessary to provide machining openings in the area of the rocker cover, e.g., for machining the bearing channels, which then have to be sealed tightly after machining to prevent diffusion of hydrocarbons.

Due to the integration of the spark plug domes 126 into the rocker cover 110, designs using magnesium alloy are also possible in comparison with embodiments in which the spark plug domes are cast jointly together with the cylinder head housing. Furthermore, the elimination of the gasket which is otherwise necessary as well as the simplified manufacturing are advantages in comparison with exemplary embodiments with separate tubular receptacles for the spark plugs inserted into the rocker cover.

In the present case, aluminum screws 120, 122 are used for mounting the camshaft bearing arrangements on the cylinder head housing 102, this being an advantage in particular because their thermal expansion is similar to that of the magnesium alloy used here. The aluminum screws 120, 122 that are used cannot be overtightened and behave very advantageously with respect to prestress losses of the joint.

Figure 2:
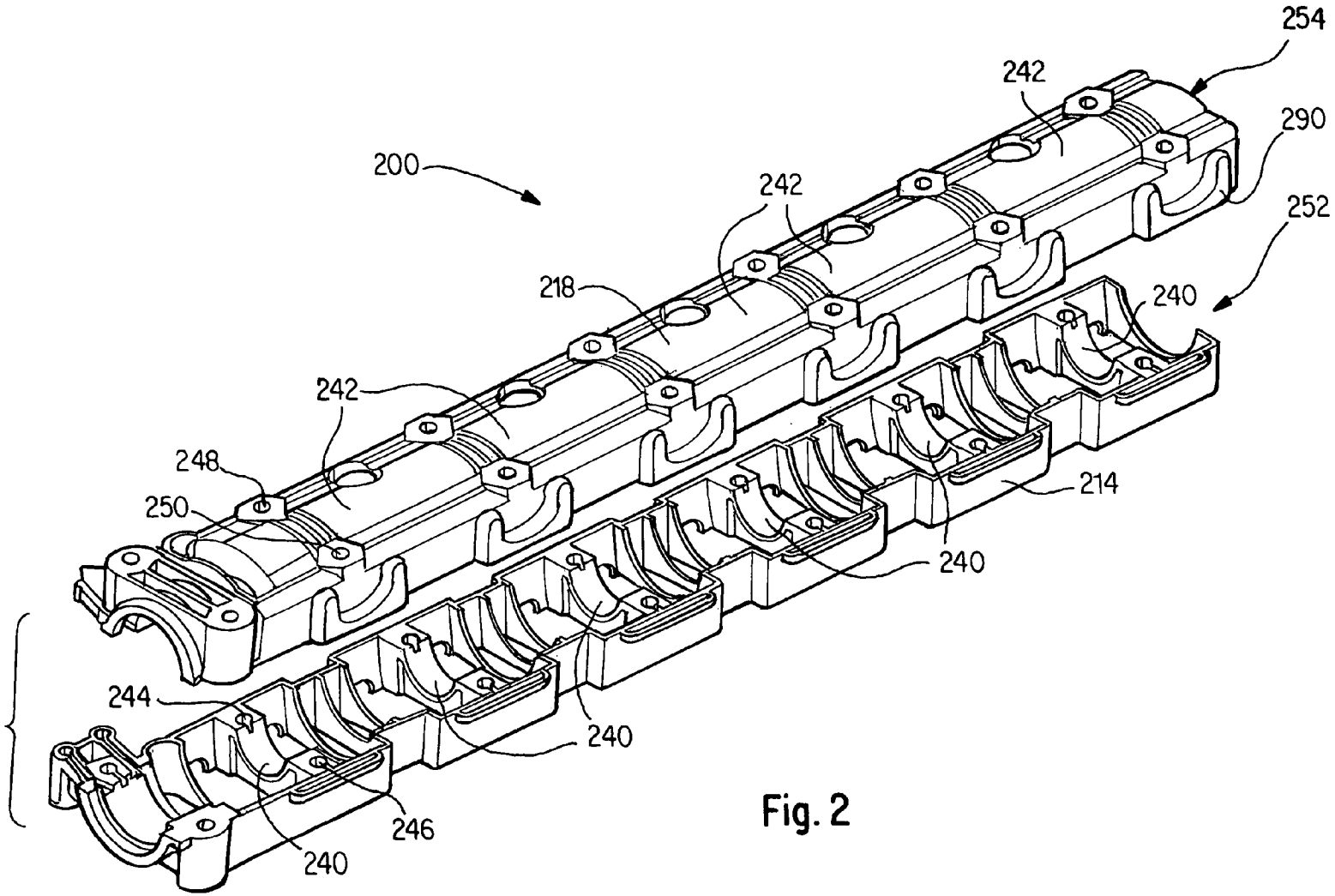
FIG. 2 shows a two-part camshaft bearing strip in a view from above in accordance with an embodiment of the present invention.

FIG. 2 shows in greater detail a two-part camshaft bearing strip 200 which comprises a lower part 252 having multiple lower bearing blocks 240 and an upper part 254 having multiple upper bearing covers. Chamber-like sections 242 are formed between the bearing sites; due to the hood-like design of the upper bearing strip 254, these chamber sections 242 are each sealed at the top so that there is effective splashguard protection for oil thrown by cams rotating in the chamber sections 242. The chamber sections 242 also fulfill the function of a preliminary oil separator. Another important point is the greatly increased rigidity in particular in the longitudinal direction due to the closed design of the upper bearing strip 254.

As already described, the camshaft bearing strip 200 is made of a magnesium alloy. The magnesium alloy used here is characterized by especially good creep behavior in particular at oil temperatures of to 150° C. For attaching both the upper bearing strip 254 to the lower bearing strip 252 and also attaching the two bearing strips 252, 254 by screws to the cylinder head housing, boreholes 244, 246, 248, 250 are provided in area of the bearing blocks.

Figure 3:
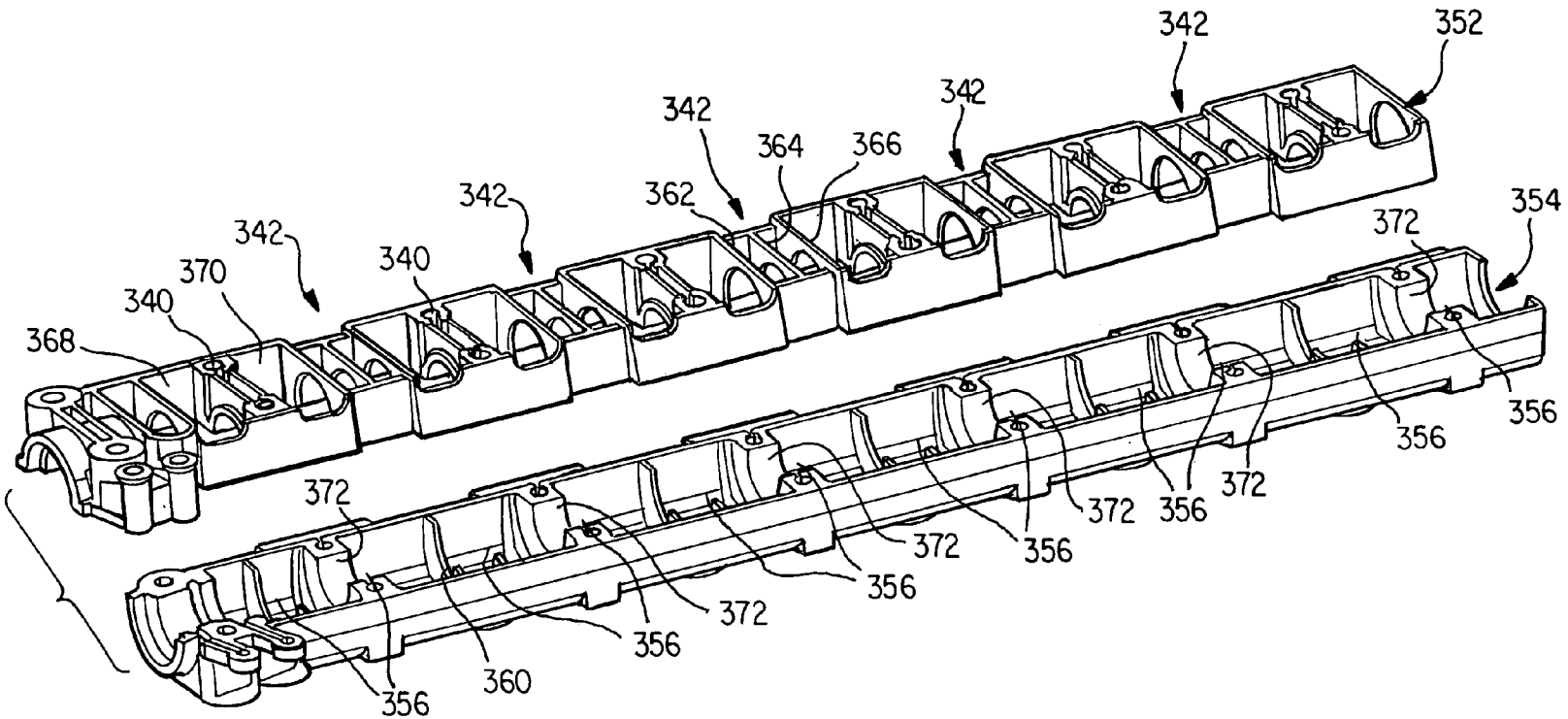
FIG. 3 shows a two-part camshaft bearing strip from beneath and in accordance with an embodiment of the present invention.

FIG. 3 shows the lower bearing strip 352 and the upper bearing strip 354 from beneath. The chamber sections 342 which are closed at the top are open at the bottom and are accessible from underneath through the lower bearing strip 352.

Each chamber section 342 is divided by webs 360 in the upper bearing strip 354 and webs 362, 364, 366 in the lower bearing strip 352 into two partial sections 368, 370 adjacent to the bearing blocks 340 in which the cams (not shown in detail here) rotate when the valves are operated. To lubricant the cams, oil outlet points 256 are provided in the upper bearing strip 354 through which oil escapes in the direction of the cams. For the transfer of oil between the oil outlet points 356 and additional oil outlet points for lubrication of the camshaft bearings, the pockets 290 having integrated oil channels as illustrated in FIG. 2 are provided.

Figure 4A:
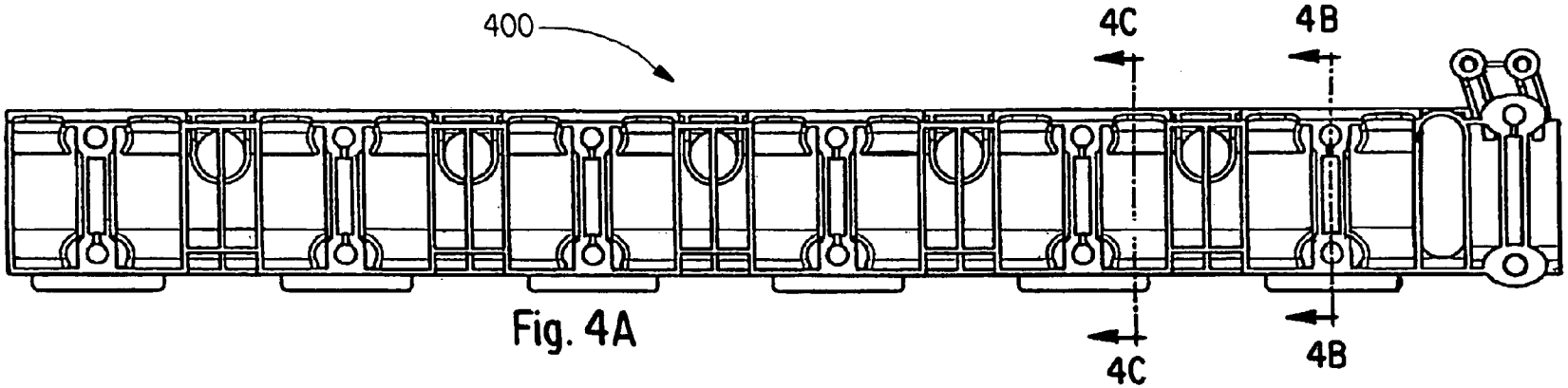
FIG. 4 shows sections through a two-part camshaft bearing strip in accordance with an embodiment of the present invention.
Figure 4B:
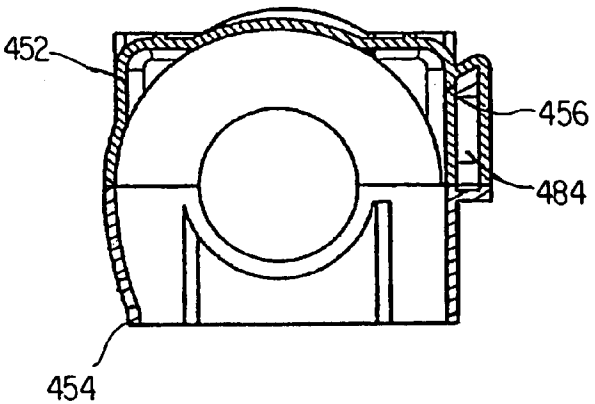
Figure 4C:
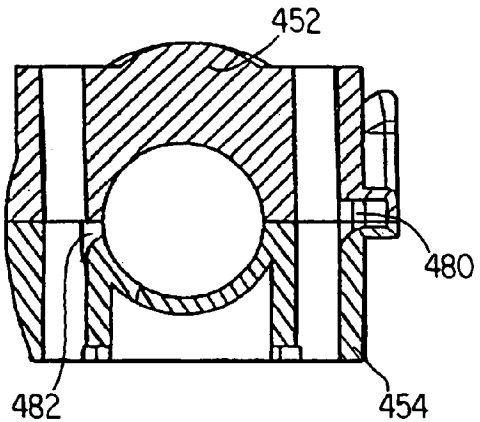

FIG. 4 shows sections A—A through the area of an oil spray nozzle 456 and B—B through the area of a camshaft bearing of the bearing strip 400. The camshaft bearing is lubricated through oil outlet points 482. Oil spray nozzles 456 for lubricating the cams with oil can be supplied with oil through an opening 480 and an oil channel 484 extending essentially axially on the outside of the camshaft bearing strip. The opening 480 is located approximately centrally in the dividing area between the upper bearing strip 452 and the lower bearing strip 454; the oil spray nozzles 456 are situated in the area of the upper bearing strip 452, with the emerging oil stream being directed obliquely downward in the direction of the cam. The entire lubrication system is supplied with oil from beneath through the cylinder head housing and the lower bearing strip.

The camshaft bearing strip described here is especially suitable for use in an internal combustion engine in which the valves are operated according to the rocker arm concept because in comparison with operation by means of bucket tappets, there is no guidance for bucket tappets provided here in the area of the lower bearing strip 252, 352 and the chamber sections 242, 342 are freely accessible from beneath. In fabrication of the bearing channel, the required supporting bearing can be introduced from beneath thus permitting a design of the chamber sections 242, 342 that is closed at the top.

The structural separation of the bearing arrangements for supporting the intake camshaft and the exhaust camshaft is made possible in particular due to the special rigidity of the construction so that a frame-like construction for joint supporting of the intake camshaft and the exhaust camshaft is not necessary and a much freer design is possible—for example, an arrangement of the intake camshaft bearing strip which is rotated by 90° with respect to its longitudinal axis as depicted in FIG. 1. This simplifies in particular the production of the camshaft bearing strip in comparison with a design for joint bearing of both the intake camshaft and the exhaust camshaft because it requires only a machine tool with one spindle instead of a machine with two parallel spindles.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Cylinder head of an internal combustion engine having a cylinder head housing, a two-part camshaft bearing strip with a lower part comprising lower bearing blocks and an upper part comprising upper bearing covers as well as a rocker cover, wherein the upper part of the camshaft bearing strip is closed in areas between the upper bearing covers, wherein spark plug domes are formed in one piece with the rocker cover.

2. Cylinder head as claimed in claim 1, wherein the camshaft bearing strip has integrated oil channels for supplying oil to at least one of the camshaft bearing and a cam.

3. Cylinder head as claimed in claim 1, wherein the camshaft bearing strip comprises a die-cast magnesium alloy.

4. Cylinder head as claimed in claim 1, wherein the camshaft bearing strip is at least partially machined independently of other cylinder head surfaces.

5. Cylinder head as claimed in claim 4, wherein supporting bearings can be introduced through the lower part from beneath for machining the bearing channel of the camshaft bearing strip.

6. Cylinder head as claimed in claim 1, wherein aluminum screws are provided for attaching the camshaft bearing strip to the cylinder head housing.

7. Cylinder head as claimed in claim 1, wherein joint faces between the camshaft bearing strip and the cylinder head housing, and also between the rocker cover and the cylinder head housing, are situated in one plane.

8. Cylinder head as claimed in claim 1, wherein a separate camshaft bearing strip is provided for the bearing of each of an intake camshaft and an exhaust camshaft.

* * * * *